US009427614B1

(12) United States Patent
Washington

(10) Patent No.: US 9,427,614 B1
(45) Date of Patent: Aug. 30, 2016

(54) JUMP ROPE AND MUSIC PLAYING COMBINATION ASSEMBLY

(71) Applicant: Emma Washington, Brooklyn, NY (US)

(72) Inventor: Emma Washington, Brooklyn, NY (US)

( * ) Notice: Subject to any disclaimer, the term of this patent is extended or adjusted under 35 U.S.C. 154(b) by 0 days.

(21) Appl. No.: 14/706,952

(22) Filed: May 7, 2015

(51) Int. Cl.

| | |
|---|---|
| ***A63B 24/00*** | (2006.01) |
| ***A63B 5/20*** | (2006.01) |
| ***H04R 1/02*** | (2006.01) |
| ***F21V 33/00*** | (2006.01) |

(52) U.S. Cl.
CPC ..... *A63B 5/20* (2013.01); *F21V 33/0064* (2013.01); *H04R 1/028* (2013.01); *H04R 2430/01* (2013.01)

(58) Field of Classification Search
CPC ..... A63B 5/20; A63B 5/22; A63B 21/0608; H04R 1/028; H04R 2430/01; F21V 33/0064
See application file for complete search history.

(56) References Cited

U.S. PATENT DOCUMENTS

| | | | | |
|---|---|---|---|---|
| 3,778,053 | A | 12/1973 | Smith, III et al. | |
| 5,533,947 | A | 7/1996 | Tomlinson et al. | |
| D402,717 | S | 12/1998 | Stark | |
| 5,842,766 | A | 12/1998 | Scharf, III | |
| 6,001,048 | A | 12/1999 | Taylor | |
| 6,409,636 | B1 | 6/2002 | Risso et al. | |
| 6,540,649 | B1 * | 4/2003 | Niedrich | A63B 21/0608 482/109 |
| 7,892,145 | B2 * | 2/2011 | Lovett | A63B 5/20 482/1 |
| 8,814,753 | B2 * | 8/2014 | Lam | A63B 5/22 482/1 |
| 9,211,429 | B2 * | 12/2015 | Heinrich | A63B 5/20 |
| 2005/0192164 | A1 | 9/2005 | Epstein | |
| 2013/0288860 | A1 | 10/2013 | Massey | |
| 2014/0038780 | A1 | 2/2014 | Lin et al. | |

* cited by examiner

*Primary Examiner* — Glenn Richman

(57) ABSTRACT

A jump rope and music playing combination assembly includes a pair of housings each defining a handle. Each of the housings has a first end, a second end and a perimeter wall extending between the first and second ends. A tether is attached to and extends between the first ends of the housings. A sound emitter is positioned in one of the housings and plays stored audio files.

7 Claims, 5 Drawing Sheets

JUMP ROPE AND MUSIC PLAYING COMBINATION ASSEMBLY

BACKGROUND OF THE DISCLOSURE

Field of the Disclosure

The disclosure relates to jump rope devices and more particularly pertains to a new jump rope device for playing music while a person uses a jump rope.

SUMMARY OF THE DISCLOSURE

An embodiment of the disclosure meets the needs presented above by generally comprising a pair of housings each defining a handle. Each of the housings has a first end, a second end and a perimeter wall extending between the first and second ends. A tether is attached to and extends between the first ends of the housings. A sound emitter is positioned in one of the housings and is configured to play stored audio files.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
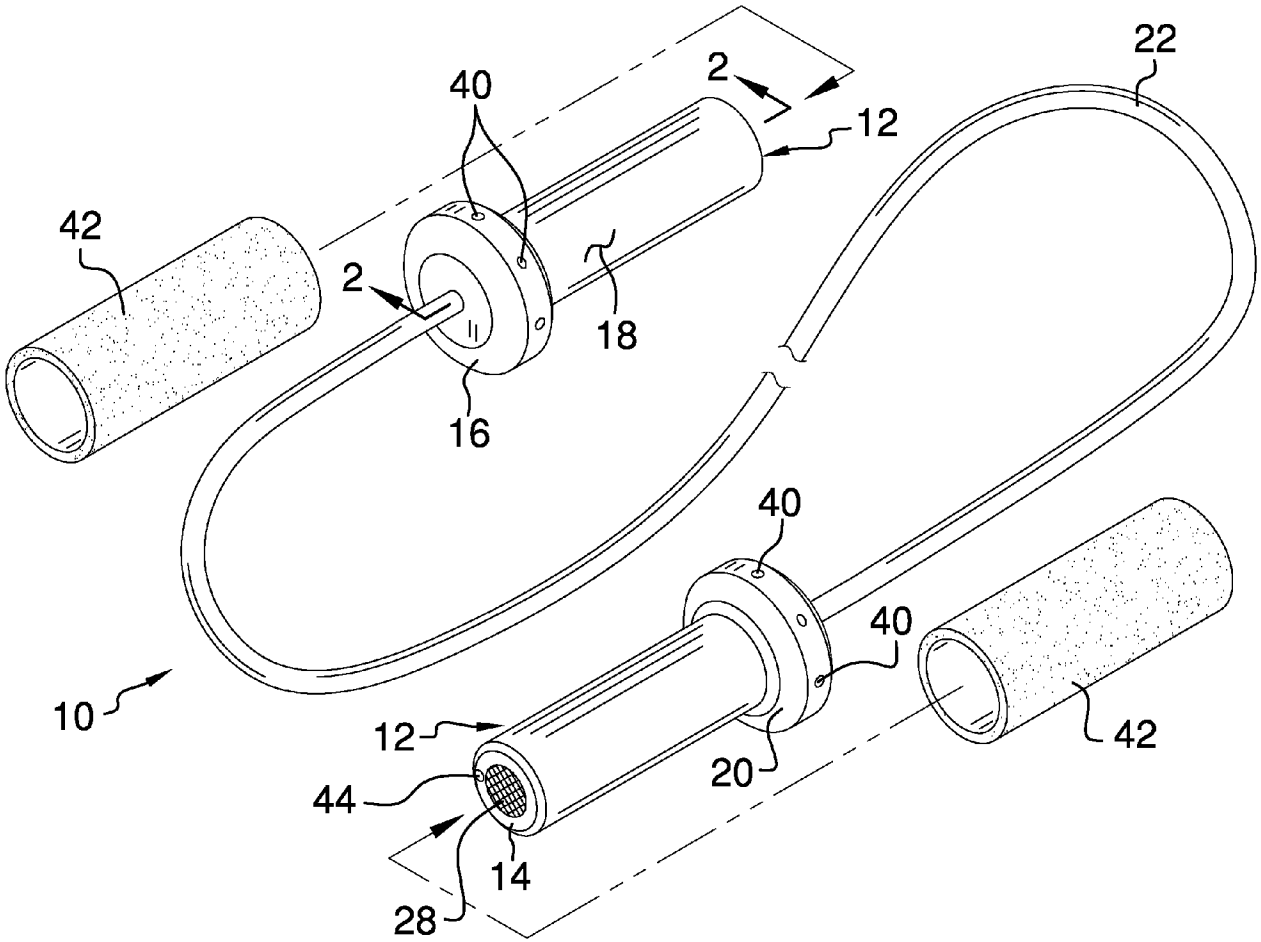
FIG. 1 is a broken top perspective view of a jump rope and music playing combination assembly according to an embodiment of the disclosure.
Figure 2:
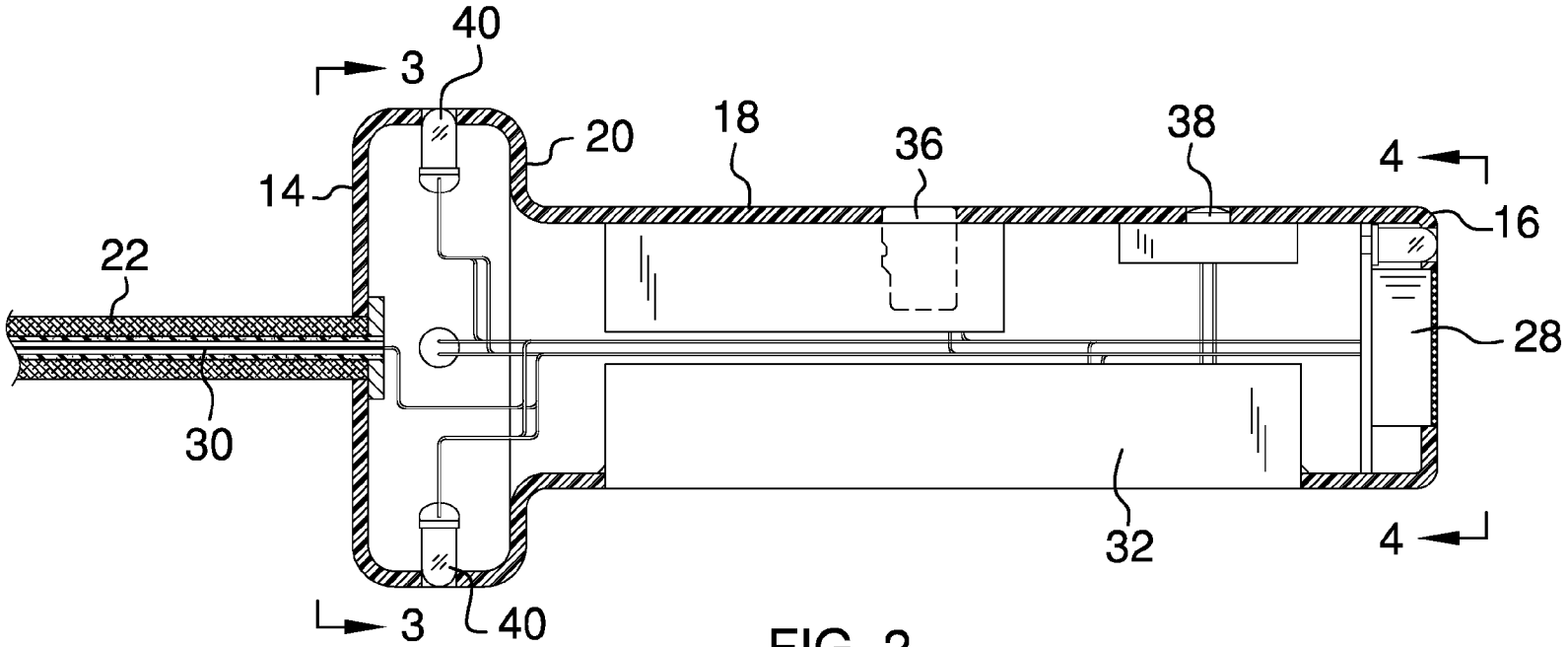
FIG. 2 is a cross-sectional view of an embodiment of the disclosure taken along line 2-2 of FIG. 1.
Figure 4:
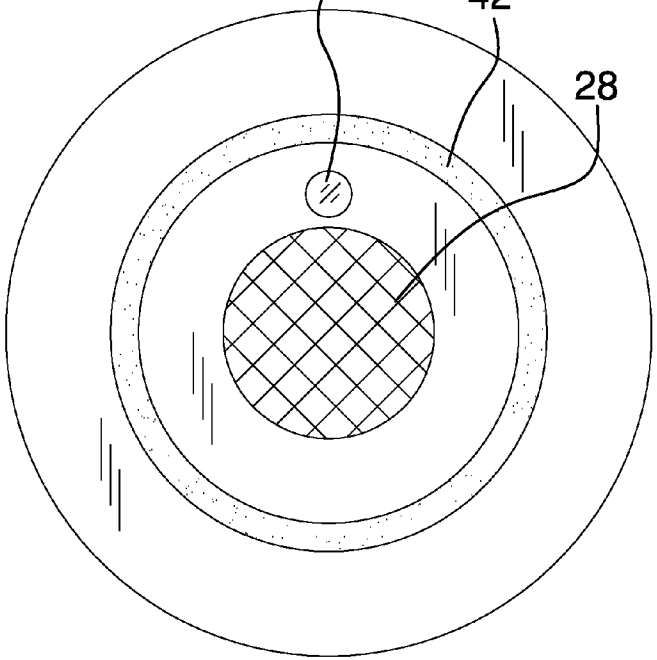
FIG. 4 is an end view of an embodiment of the disclosure.
Figure 3:
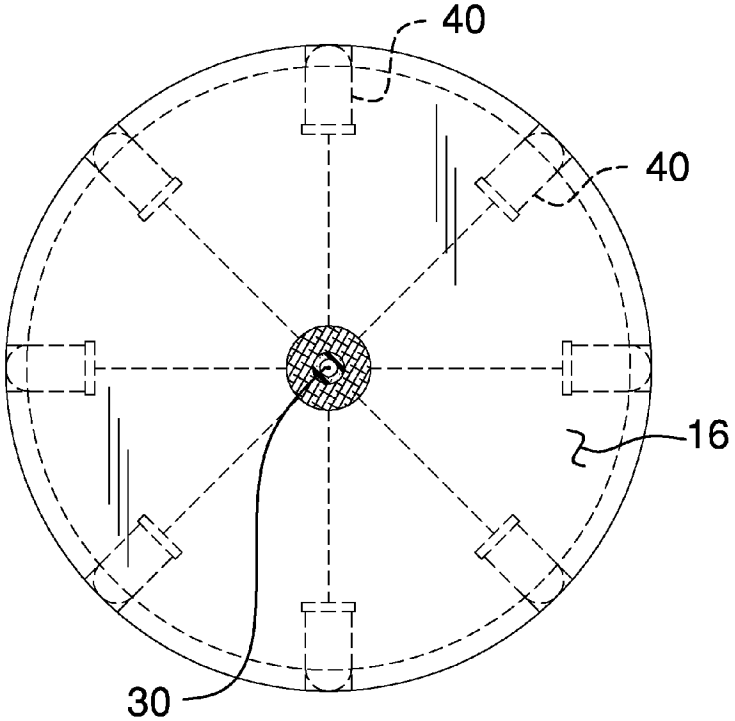
FIG. 3 is a cross-sectional view of an embodiment of the disclosure taken along line 3-3 of FIG. 2.
Figure 5:
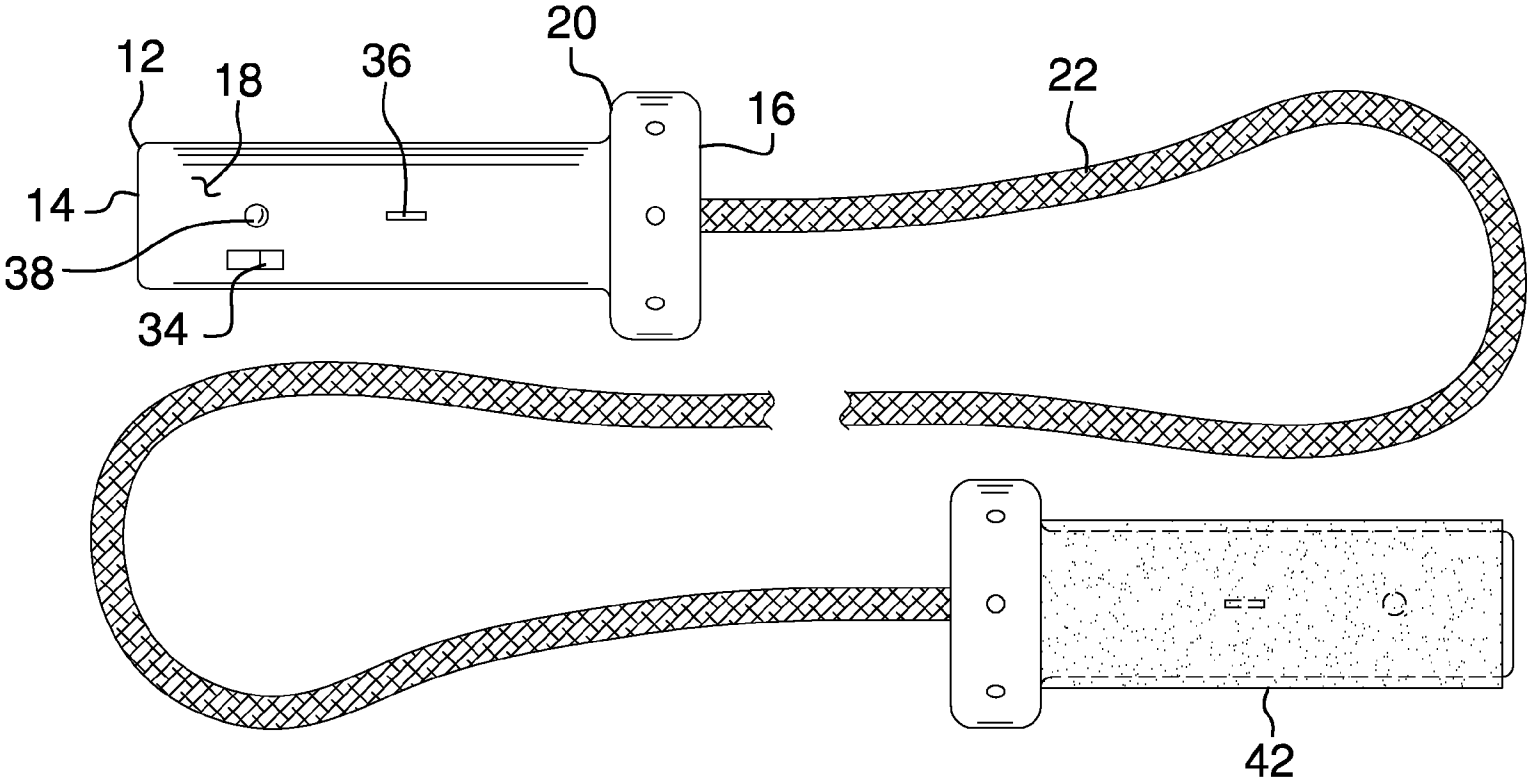
FIG. 5 is a top broken view of an embodiment of the disclosure.
Figure 6:
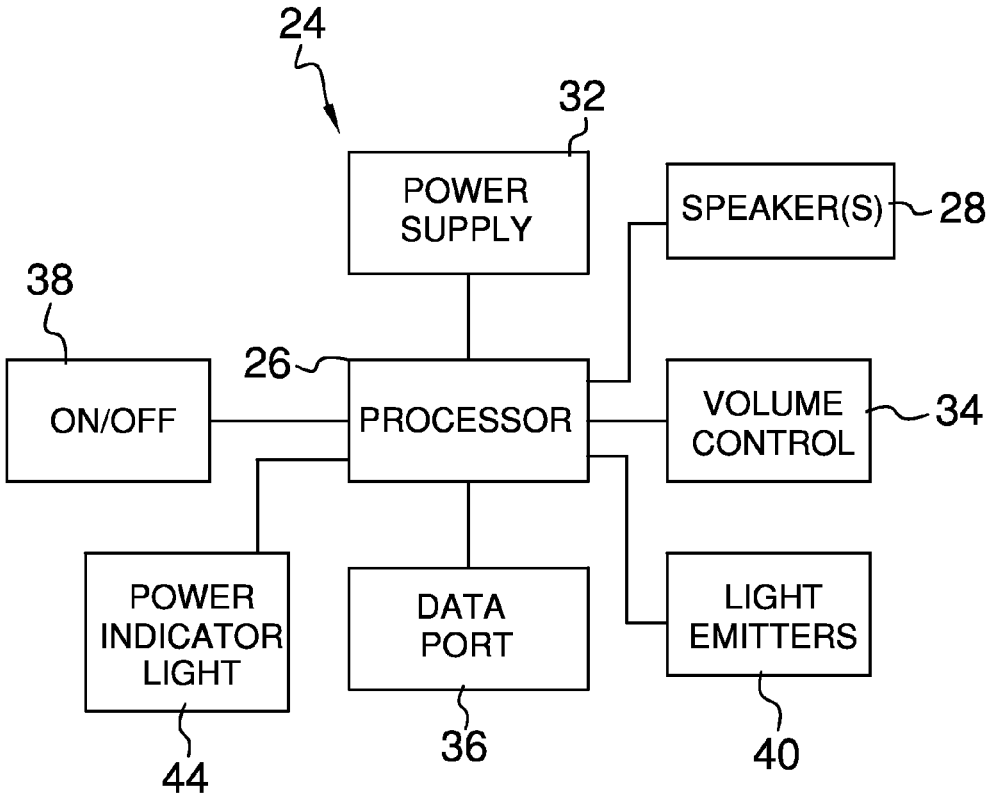
FIG. 6 is a schematic view of an embodiment of the disclosure.

With reference now to the drawings, and in particular to FIGS. 1 through 5 thereof, a new jump rope device embodying the principles and concepts of an embodiment of the disclosure and generally designated by the reference numeral 10 will be described.

As best illustrated in FIGS. 1 through 5, the jump rope and music playing combination assembly 10 generally comprises a pair of housings 12 each defining a handle to be gripped by a user. Each of the housings 12 has a first end 14, a second end 16 and a perimeter wall 18 extending between the first 14 and second 16 ends. The perimeter wall 18 has a shoulder 20 therein positioned nearer to the first end 14 than the second end 16. A portion of the perimeter wall 18 between the shoulder 20 and the first end 14 defines a stop. The housings 12 each have a length from the first end 14 to the associated second end 16 being less than approximately 6.0 inches. The housings 12 may be cylindrically shaped and have a diameter between 0.75 inches and 2.0 inches.

A tether 22 is attached to and extends between the first ends 14 of the housings 12. The tether 22 has a length between 5.0 feet and 12.0 feet. The tether 22 may be comprised of a woven material or a plastic material which is flexible.

A sound emitter 24 is positioned in one, or both, of the housings 12 and is configured to play stored audio files. The sound emitter 24 includes a processor 26, such as a conventional control processing unit, and a speaker 28 that is electrically coupled to the processor 26. The speaker 28 may be mounted in the second end 16 of the housing 12 and audibly plays audio files. A second speaker 28 may be provided such that each housing 12 includes a speaker 28. Conduits 30 may extend through the tether 22 to couple the second speaker 28, mounted on the housing 12 not containing the processor 26, to the processor 26. A power supply 32 is electrically coupled to the processor 26. The power supply 26 may comprise one or more batteries and may more particularly comprise a rechargeable battery. A volume control 34 is electrically operationally coupled to the processor 26. A port 36 is electrically coupled to the processor 26 and is configured to receive a memory card has at least one audio file thereon. The port 36 may comprise any conventional data port for transfer electronic information by wire. Alternatively, or in addition, an electronic memory may be positioned within the housing 12 and electrically coupled to the processor 26 for retaining audio files thereon which have been transferred thereto by an outside data source. Further, additional means of audio file transfers may be accomplished such as by utilizing a wireless signal from an external storage device to the processor by way of radio transmitters. A power switch 38 is operationally coupled to the processor 24 and is actuated to turn the processor 24 or on off.

A plurality of light emitters 40 may be provided. Each of the stops, or areas adjacent to the shoulders 20, has at least four of the light emitters 40 mounted thereon and each of the light emitters 40 is electrically coupled to the processor 24 to be illuminated when the processor 24 is turned on. The processor 24 may be programmed in a conventional fashion to cause the light emitters 40 to only turn on with the beat of the song being audibly played on the speaker 28.

A pair of coverings 42 is provided. Each of the perimeter walls 18 has one of the coverings 42 positioned thereon. The coverings 42 may each be comprised of a resiliently compressible material such as a foamed elastomeric material.

In use, the housings 12 are each gripped and the assembly 10 is used in a conventional manner as would a traditional jump rope be used. The user may turn on the processor 24 as desired so that music is emitted from the speaker. A power light 44 may be positioned on the housing 12 and electrically coupled to the processor to be illuminated when the processor 24 turned as an indication that the assembly 10 has been powered on. The assembly 10 may include selection switches operationally coupled to the processor 24 to select different audio files. Alternatively the processor 24 may be programmed so that the audio files are simply played in order, or randomly selected, without user input.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A jump rope assembly comprising:

a pair of housings each defining a handle, each of said housings having a first end, a second end and a perimeter wall extending between said first and second ends, wherein said perimeter wall of each of said housings has a shoulder therein positioned nearer to said first end than said second end, a portion of said perimeter wall between said shoulder and said first end defining a stop;

a tether being attached to and extending between said first ends of said housings;

a sound emitter being positioned in one of said housings, said sound emitter being configured to play stored audio files; and a plurality of light emitters, each of said stops having at least four of said light emitters mounted thereon, each of said light emitters being electrically coupled to said processor and being illuminated when said processor is turned on.

2. The jump rope assembly according to claim 1, wherein said tether has a length between 5.0 feet and 12.0 feet.

3. The jump rope assembly according to claim 1, wherein said sound emitter includes:

a processor;

a speaker being electrically coupled to said processor, said speaker audibly playing audio files; and a power supply being electrically coupled to said processor.

4. The jump rope assembly according to claim 3, wherein said sound emitter further includes a port electrically coupled to said processor and being configured to receive a memory card having at least one audio file thereon.

5. The jump rope assembly according to claim 1, further including a pair of coverings, each of said perimeter walls having one of said coverings positioned thereon.

6. The jump rope assembly according to claim 5, wherein each of said coverings is comprised of a resiliently compressible material.

7. A jump rope assembly comprising:

a pair of housings each defining a handle, each of said housings having a first end, a second end and a perimeter wall extending between said first and second ends, said perimeter wall having a shoulder therein positioned nearer to said first end than said second end, a portion of said perimeter wall between said shoulder and said first end defining a stop;

a tether being attached to and extending between said first ends of said housings, said tether having a length between 5.0 feet and 12.0 feet;

a sound emitter being positioned in one of said housings, said sound emitter being configured to play stored audio files, said sound emitter including:

a processor;

a speaker being electrically coupled to said processor, said speaker audibly playing audio files;

a power supply being electrically coupled to said processor;

a volume control being electrically operationally coupled to said processor;

a port electrically coupled to said processor and being configured to receive a memory card having at least one audio file thereon;

a power switch being operationally coupled to said processor and being actuated to turn said processor or on off;

a pair of coverings, each of said perimeter walls having one of said coverings positioned thereon, each of said coverings being comprised of a resiliently compressible material; and a plurality of light emitters, each of said stops having at least four of said light emitters mounted thereon, each of said light emitters being electrically coupled to said processor and being illuminated when said processor is turned on.

* * * * *